US008164278B2

(12) United States Patent
Huang

(10) Patent No.: US 8,164,278 B2
(45) Date of Patent: Apr. 24, 2012

(54) OUTPUT BUFFER AND SOURCE DRIVER USING THE SAME

(75) Inventor: Da-Rong Huang, Tainan County (TW)

(73) Assignee: Himax Technologies Limited, Tainan (TW)

( * ) Notice: Subject to any disclaimer, the term of this patent is extended or adjusted under 35 U.S.C. 154(b) by 611 days.

(21) Appl. No.: 12/354,591

(22) Filed: Jan. 15, 2009

(65) Prior Publication Data

US 2010/0176747 A1 Jul. 15, 2010

(51) Int. Cl.
*H05B 41/36* (2006.01)

(52) U.S. Cl. ..... 315/307; 345/211; 345/204; 315/291

(58) Field of Classification Search ..... None
See application file for complete search history.

(56) References Cited

U.S. PATENT DOCUMENTS

| | | | | |
|---|---|---|---|---|
| 7,545,170 | B2 * | 6/2009 | Chang et al. | 326/63 |
| 7,551,030 | B2 * | 6/2009 | An et al. | 330/255 |
| 2006/0066400 | A1 * | 3/2006 | Kang et al. | 330/255 |
| 2006/0279509 | A1 * | 12/2006 | Milanesi | 345/100 |

* cited by examiner

*Primary Examiner* — Shawki S Ismail
*Assistant Examiner* — Crystal L Hammond
(74) *Attorney, Agent, or Firm* — J.C. Patents

(57) ABSTRACT

An output buffer and a source driver using the same are provided. The output buffer includes an input stage module, a first output stage module, a second output stage module, and a first control module. The input stage module generates a first bias signal via a first connection terminal according to a driving signal and a output signal. The first output stage module generates the output signal in response to the first bias signal via an output terminal of the output buffer. The second output stage module generates a second bias signal in response to the first bias signal via a second connection terminal, and controls a first switch in the second output stage module. The first control module selectively connects a first current source to the output terminal of the output buffer or to the second connection terminal of the second output stage module according to an indication signal.

19 Claims, 6 Drawing Sheets

OUTPUT BUFFER AND SOURCE DRIVER USING THE SAME

BACKGROUND OF THE INVENTION

1. Field of the Invention

The present invention generally relates to an output buffer and a source driver using the same, and more particularly, to the output buffer that increases driving abilities of charging and discharging without additional power consumption.

2. Description of Related Art

A source driver is an important element in a liquid crystal display (LCD). The source driver mainly includes a shift register for controlling a data latch to receive a digital video signal from a data bus by timing control, a digital-to-analog converter for converting the digital video signal into an analog driving signal, an output buffer for enhancing a driving ability of the driving signal, and an output multiplexer for outputting the driving signal to pixels on a display panel for displaying images.

FIG. 1 is a circuit diagram of a conventional output buffer in the source driver. Referring to FIG. 1, the output buffer 100 includes an input stage 110, a charging output stage 120, and a discharging output stage 130. The input stage 110 controls the charging output stage 120 and the discharging output stage 130 according to signals at input nods Vi+ and Vi−, wherein the output buffer 100 is a unity gain buffer having the input terminal Vi− coupled to an output terminal Vout thereof. When the signal at the input terminal Vi+ is larger than the signal at the input terminal Vi−, an induced current I1 is decreased to conduct a transistor M6 and a transistor M8. The conducted transistor M6 forms a charging path to increase a voltage at the output terminal Vout, and the conducted transistor M8 increases a voltage at terminal N1 for making a transistor M10 not conduct. In addition, when the signal at the input terminal Vi+ is less than the signal at the input terminal Vi−, the induced current I1 is increased to make the transistors M6 and M8 not conduct. In the meanwhile, a transistor M9 conducted by a bias voltage Vb pulls low the voltage at terminal N1, and then conducts a transistor M10 to form a discharging path so as to decrease the voltage at the output terminal Vout.

With the increase of the operation frequency, the source driver may not have sufficient time to charge/discharge the output terminal Vout to a target voltage, and then deliver the target voltage to the pixels on display panel to orient liquid crystal corresponding to the pixels. Therefore, the output buffer 100 should increase driving abilities of charging and discharging to increase a slew rate of the driving signal. However, designers may increase the width-to-length ratios of transistors to increase a charging/discharging current of the output buffer 100, but more power consumption and layout area would be necessary. There should be a proper circuit design in the output buffer for increasing the driving abilities of charging and discharging.

SUMMARY OF THE INVENTION

Accordingly, the present invention provides an output buffer and a source driver using the same that increases the driving abilities of charging and discharging thereof without additional power consumption.

An output buffer adapted to a source driver is provided in the present invention. The output buffer includes an input stage module, a first output stage module, a second output stage module, and a first control module. A first input terminal and a second input terminal of the input stage module respectively receive a driving signal and an output signal, and a first connection terminal of the input stage module generates a first bias signal in response to the driving signal and the output signal. The first output stage module and the second output stage module are coupled to the first connection terminal of the input stage module. The first output stage module generates the output signal in response to the first bias signal, and outputs the output signal to a display panel via an output terminal of the output buffer. The second output stage module generates a second bias signal in response to the first bias signal, and outputs the second bias signal via a second connection terminal. The second output stage includes a first switch having a first terminal coupled to the output terminal of the output buffer, and a second terminal coupled to a first voltage. The first switch is conducted according to the second bias signal. The first control module is coupled between the output terminal of the output buffer and the second connection terminal of the second output stage module. The first control module selectively connects a first current source to the output terminal of the output buffer or to the second connection terminal of the second output stage module according to an indication signal.

A source driver adapted to drive a display panel is provided in the present invention. The source driver includes the said output buffer in the present invention, and an output multiplexer. The output multiplexer conducts the output terminal of the output buffer to the display panel according to a switching signal.

In an embodiment of the present invention, the input stage module includes a differential pair, a current mirror circuit, and a second current source. The differential pair includes a first transistor and a second transistor. The first transistor has a gate receiving the driving signal and a first source/drain coupled to the current mirror circuit. The second transistor has a gate receiving the output signal, a first source/drain coupled to the current mirror circuit to generate the first bias signal, and a second source/drain coupled to the second source/drain of the first transistor. The current mirror circuit respectively provides a first bias current and a second bias current to the first source/drain of the first transistor and the first source/drain of the second transistor. A first terminal of the second current source is coupled to the second source/drain of the first transistor, and a second terminal of the second current source is coupled to the first voltage.

In an embodiment of the present invention, the foregoing output buffer further includes a second control module. The second control module is coupled between the second source/drain of the first transistor and the output terminal of the output buffer for selectively connecting a third current source to the second terminal of the first transistor or to the output terminal of the output buffer according to the indication signal.

In an embodiment of the present invention, the second control module includes a second switch and a third switch. A first terminal and a second terminal of the second switch are respectively coupled to the second source/drain of the first transistor, and the third current source, wherein the second switch is conducted according to an inverted indication signal. A first terminal and a second terminal of the third switch are respectively coupled to the second terminal of the second switch and the output terminal of the output buffer, wherein the third switch is conducted according to the indication signal.

In an embodiment of the present invention, the first control module includes a fourth switch and a fifth switch. A first terminal and a second terminal of the fourth switch are respectively coupled to the output terminal of the output buffer and the first current source, wherein the fourth switch is conducted according to an inverted indication signal. A first terminal and a second terminal of the fifth switch are respectively coupled to the second terminal of the fourth switch and the second connection terminal of the second output stage module, wherein the fifth switch is conducted according to the indication signal.

The output buffer and the source driver using the same of the present invention utilizes the first control module to selectively connect the first current source to the first output stage module or to the second output stage, such that the current flowing through the first output stage module and the current flowing through the second output stage module can be adjusted for increasing the driving abilities of charging and discharging. In addition, the second control module can selectively connect the third current source to the input stage module or to the first output stage module for adjusting a tail current of the input stage module and the current flowing through the first output stage module.

In order to make the features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
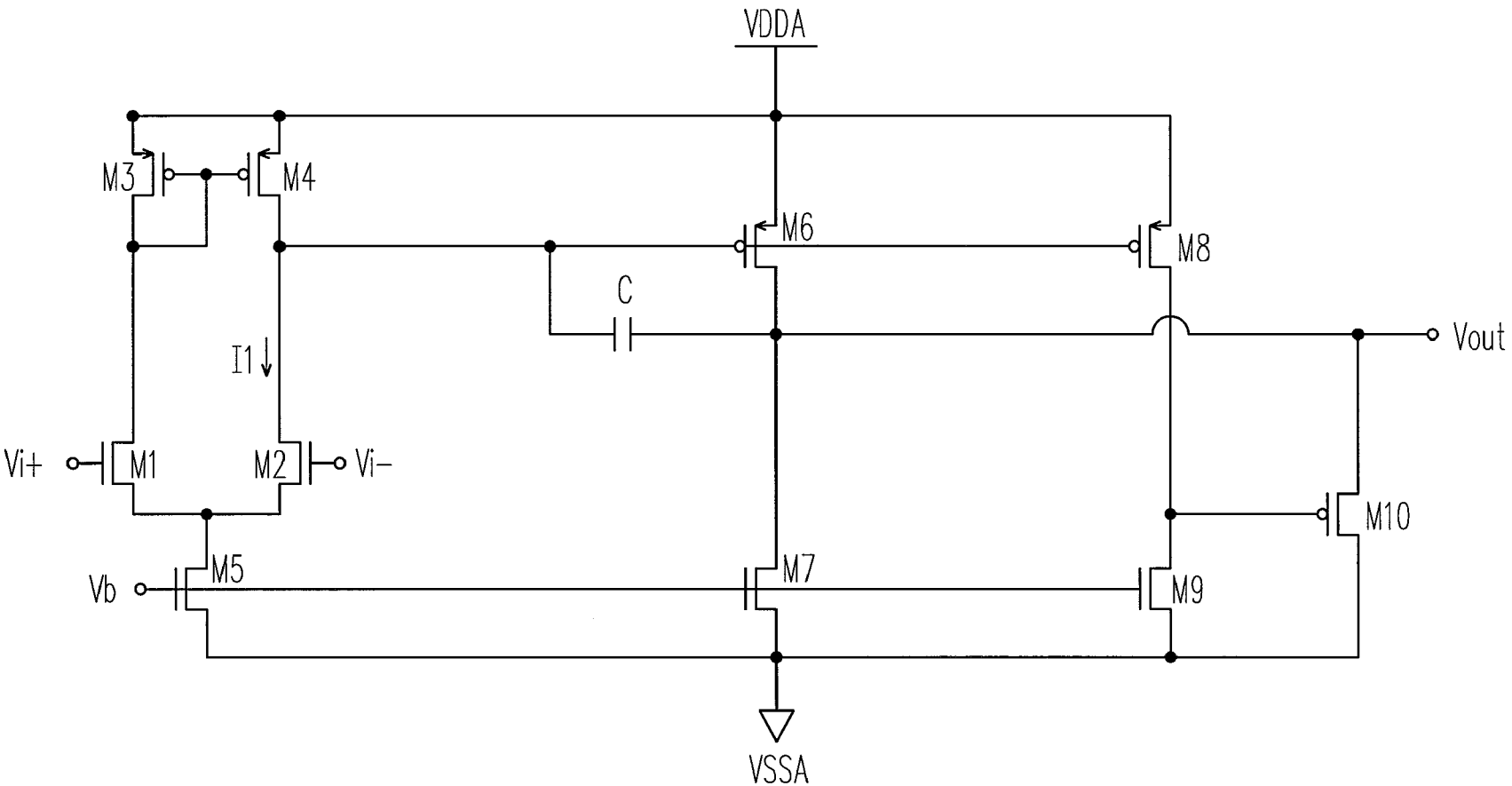
FIG. 1 (PRIOR ART)
FIG. 1 is a circuit diagram of a conventional output buffer in the source driver.

Reference will now be made in detail to the present preferred embodiments of, the invention, examples of which are illustrated in the accompanying drawings. Wherever possible, the same reference numbers are used in the drawings and the description to refer to the same or like parts.

Figure 2:
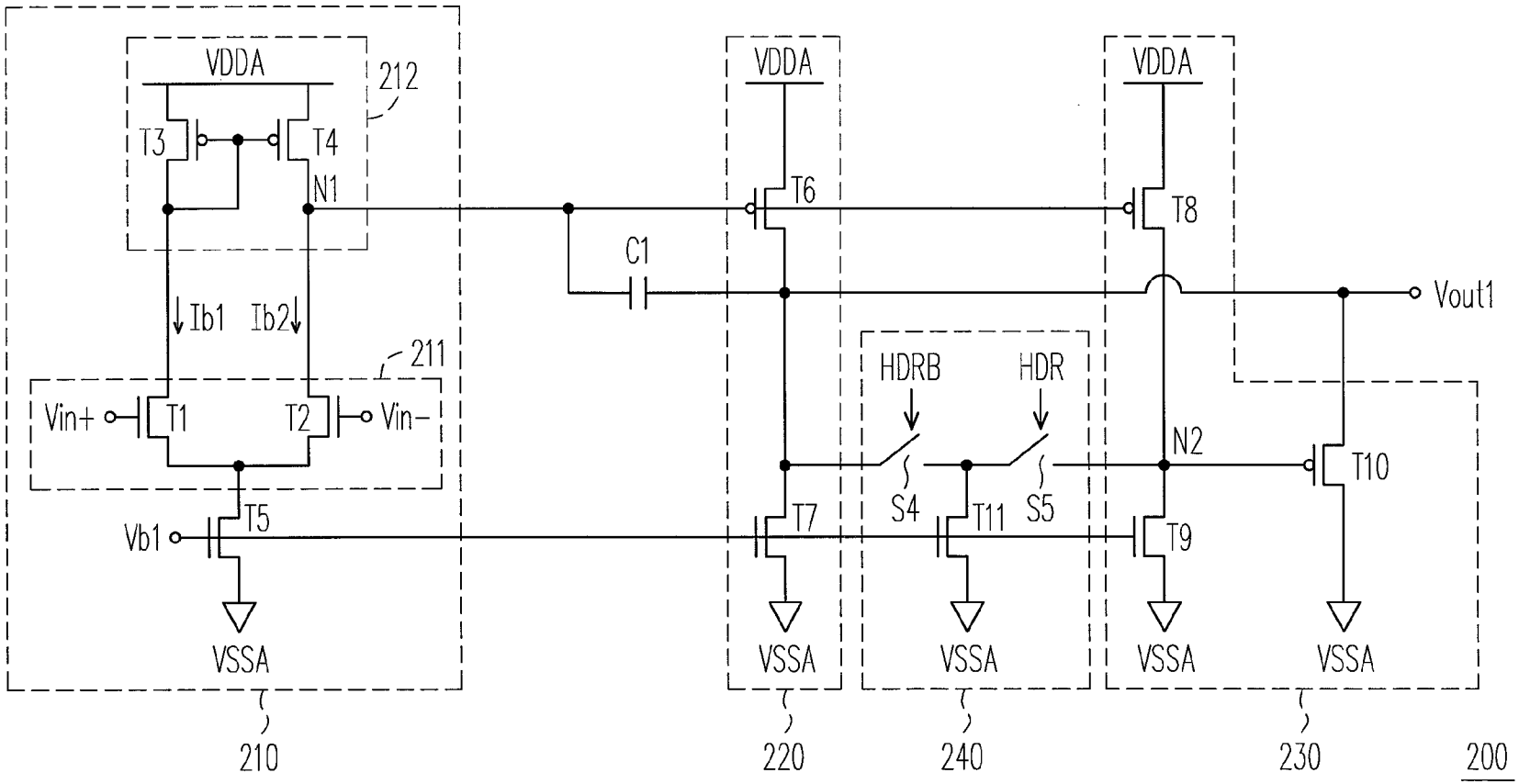
FIG. 2 is a circuit diagram of an output buffer according an embodiment of the present invention.

FIG. 2 is a circuit diagram of an output buffer according an embodiment of the present invention. Referring to FIG. 2, the output buffer 200 includes an input stage module 210, a first output stage module 220, a second output stage module 230, and a first control module 240. The input stage module 210 controls the first output stage module 220 and the second output stage module 230 to operate according to signals at input terminals Vin+ and Vin−. In the embodiment of the present invention, the output buffer 200 is a unity gain buffer in which an output terminal Vout1 is coupled to the input terminals Vin−, so that the input stage module 210 receives a driving signal via the input terminal Vin+, and receives an output signal from the output terminal Vout1 via the input terminal Vin−.

The input stage module 210 includes a differential pair 211 composed of transistors T1 and T2, a current mirror circuit 212 composed of transistor T3 and T4, and a current source implemented by a transistor T5. The transistor T5 biased by a bias voltage Vb1 provides a bias current Ib to drive the differential pair 211, and then the current mirror circuit 212 induces a first bias current Ib1 and a second bias current Ib2 to the differential pair 211 according to the signals at the input terminals Vin+ and Vin−, wherein a sum of the first bias current Ib1 and the second bias current. Ib2 is substantially equal to the bias current Ib. The input stage module 210 generates a first bias signal via a first connection terminal N1 thereof for controlling the first output stage module 220 and the second output stage module 230 to operate.

The first output stage module 220 includes transistors T6 and T7, wherein the conductive states of the transistors T6 and T7 are respectively determined by the first bias signal from the first connection terminal N1 and the bias voltage Vb1. The first output stage module 220 generates the output signal via the output terminal Vout1 according to the first bias signal from the first connection terminal N1. When the driving signal at the input terminal Vin+ is larger than the, output signal at the input terminal Vin−, the voltage (i.e. the first bias signal) at the first connection terminal N1 is decreased to conduct the transistor T6, and then the conducted transistor T6 forms a charging path to pull high the voltage (i.e. the output signal) at the output terminal Vout1. In the embodiment of the present invention, the output buffer 200 further includes a capacitor C1 coupled between the first connection terminal N1 and the output terminal Vout1 for compensating a phase margin of the output buffer 200.

The second output stage module 230 includes transistors T8 and T9, and a switch implemented by a transistor T10, wherein the conductive states of the transistors T8 and T9 are respectively determined by the first bias signal from the first connection terminal N1 and the bias voltage Vb1. The second output stage module 230 generates a second bias signal via a second connection terminal N2 thereof according to the first bias signal from the first connection terminal N1. When the driving signal at the input terminal Vin+ is less than the output signal at the input terminal Vin−, the voltage (i.e. the first bias signal) at the first connection terminal N1 is increased to make the transistors T6 and T8 not conduct. In the meanwhile, the transistor T9 biased by the bias voltage Vb1 is conducted to decrease the voltage (i.e. the second bias signal) at the second connection terminal N2, and then conduct the transistor T10 to form a discharging path so as to pull low the voltage (i.e. the output signal) at the output terminal Vout1.

Referring to FIG. 1, generally, a width-to-length ratio of the transistor M7 is designed to be larger than a width-to-length ratio of the transistor M9 in order to decrease a leakage current produced by the transistor M7 and easily control the conductive state of transistor M10. For example, the width-to-length ratio of the transistor M7 is five times the width-to-length ratio of the transistor M9 in a prior art. If the width-to-length ratio of the transistor M9 is also designed to be larger, a higher bias voltage Vb1 may be needed to conduct the transistor M9. However, the limitation of the width-to-length ratio of the transistor M9, a discharging ability of the output buffer 100 is limited. Therefore, the embodiment of the present invention utilizes the first control module 240 to adjust the current flowing through the first output stage module 220 and the current flowing through the second output stage module 230 so as to increase the driving ability of the output buffer 200.

The first control module 240 includes switches S4 and S5, and a current source implemented by a transistor T11. The first control module 240 selectively connects the current source implemented by the transistor T11 to the first output stage module 220 or to the second output stage module 230 according to an indication signal HDR, wherein the switches S4 and S5 are respectively controlled by an inverted indication signal HDRB and the indication signal HDR. In the embodiment of the present invention, a current that the transistor T11 can produce is one part of the first output stage module 220. For example, a sum of the width-to-length ratios of the transistor T7 and T11 is five times the width-to-length ratios of the transistors T5 and T9, and the width-to-length ratio of the transistor T11 is four times the width-to-length ratio of the transistor T5, T7, and T9.

When the indication signal HDR is de-asserted, the current source implemented by the transistor T11 is connected to the output terminal Vout1 through the switch S4 conducted by the inverted indication signal HDRB, wherein the inverted indication signal HDRB is inverted from the indication signal HDR. In the meanwhile, the output buffer 200 operates as normal, i.e. the transistor T6 forms a charging path to pull high the voltage at the output terminal Vout1 when the output buffer is in a charging state. In addition, when the indication signal HDR is asserted, the second output stage module 230 borrows the current source implemented by the transistor T11 from the first output stage module 220 through the switch S5 conducted by the indication signal HDR. In the meanwhile, the voltage at the second connection terminal can be quickly decreased to conduct the transistor T10 and then the voltage at the output terminal is pulled low when the output buffer 200 is in discharging state. As a result, by the operation of the first control module 240, a slew rate of the output signal is increased for enhancing the driving ability of the output buffer 200. Since the current source implemented by the transistor T11 is originally derived from the first output stage module 220, the output buffer 200 would not cost additional power consumption and layout area.

It is noted that the transistors M6 and M10 may be simultaneously conducted during a transition period of changing from the charging/discharging state to the discharging/charging state. The output buffer 200 should be kept in high impedance during the transition period for ensuring the operation is correct. For example, during the transition period, an output multiplexer (not shown) coupled between the output terminal Vout1 and the display panel could be inactivated by a switching signal for disconnecting the output buffer 200 from the display panel.

Figure 3C:
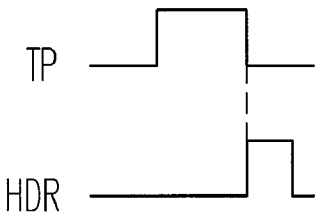
FIG. 3A, FIG. 3B, FIG. 3C are timing diagrams of the first control module according the embodiment in FIG. 2.
Figure 3B:
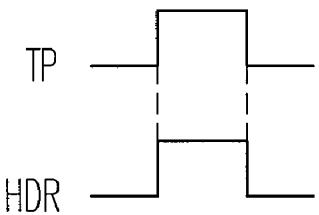
Figure 3A:
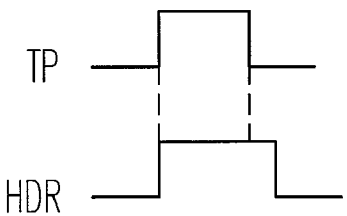

FIG. 3A, FIG. 3B and FIG. 3C are timing diagrams of the first output control module according to the embodiment in FIG. 2. Referring to FIG. 3A, the indication signal HDR is asserted to borrow the current source implemented by the transistor T11 from the first output stage module 220 when the switching signal TP is asserted to keep the output buffer 200 in high impendence, and the indication signal HDR is de-asserted to return the current source implemented by the transistor T11 to the first output stage module 220 after the switching signal TP is de-asserted, wherein the inverted indication signal HDRB is inverted from the indication signal HDR. Referring to FIG. 3C, the indication signal HDR is asserted when the switching signal TP is asserted, and the indication signal HDR is de-asserted when the switching signal TP is de-asserted. Referring to FIG. 3C, the indication signal HDR is asserted for a presetting period when the switching signal TP is de-asserted, and the indication signal is de-asserted before a scan signal associated with a scan line is de-asserted.

Figure 4:
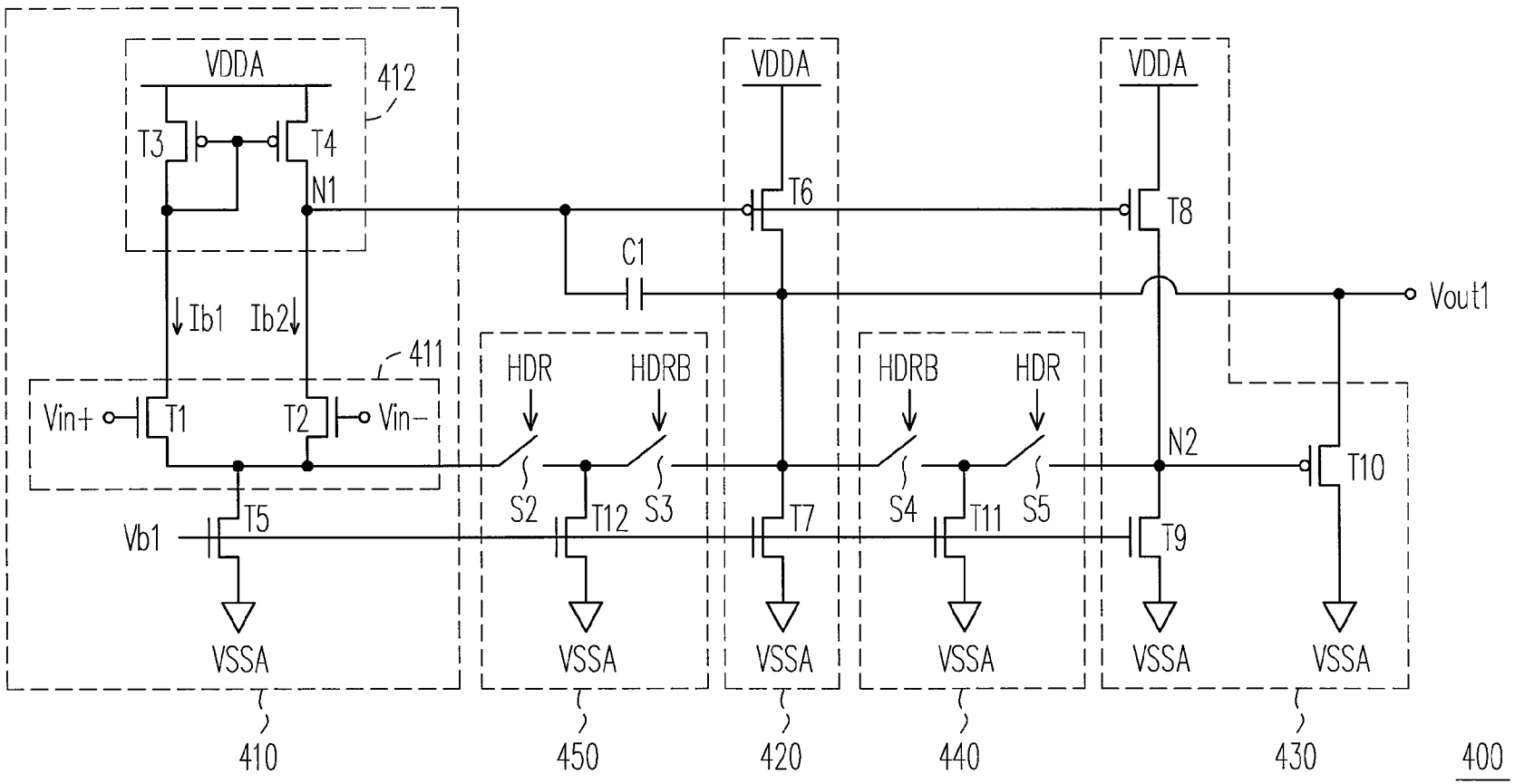
FIG. 4 is a circuit diagram of an output buffer according an embodiment of the present invention.

FIG. 4 is a circuit diagram of the output buffer according to another embodiment of the present invention. Referring to FIG. 2 and FIG. 4, the difference between the embodiments in FIG. 2 and FIG. 4 is that the output buffer 400 further includes a second control module 450 coupled between the first connection terminal N1 of the input stage module and the output terminal Vout1 of the output buffer 400. The second control module 450 includes switches S2 and S3, and a current source implemented by a transistor T12. The second control module 450 selectively connects the current source implemented by the transistor T2 to the input stage module 410 or to the first output stage module 420 according to the indication signal HDR, wherein the switches S2 and S3 are respectively controlled by the indication signal HDR and the inverted indication signal HDRB. In the embodiment of the present invention, a current that the transistor T12 can produce is one part of the first output stage module 320. For example, a sum of the width-to-length ratios of the transistors T7, T11 and T12 is five times the width-to-length ratios of the transistor T5 and T9, and the width-to-length ratios of the transistor T11 and T12 are two times the width-to-length ratios of the transistors T5, T7, and T9.

In the embodiment of the present invention, the second control module 450 can also operate according to the timing control shown in FIG. 3A through FIG. 3C. When the indication signal HDR is de-asserted, the current source implemented by the transistor T12 is connected to the output terminal Vout1 through the switch S3 conducted by the inverted indication signal HDRB. In the meanwhile, the output buffer 200 operates as normal, i.e. the transistor T6 forms a charging path to pull high the voltage at the output terminal Vout1 when the output buffer 400 is in charging state. In addition, when the indication signal HDR is asserted, the input stage module 410 borrows the current source implemented by the transistor T12 from the first output stage module 420 through the switch S2 conducted by the indication signal HDR. In the meanwhile, a tail current of the input stage module 410 is increased to increase the driving ability of the output buffer 400 by the operation of the second control module 450. Since the current source implemented by the transistor T12 is originally derived from the first output stage module 420, the output buffer 400 would not cost additional power consumption and layout area.

Figure 5:
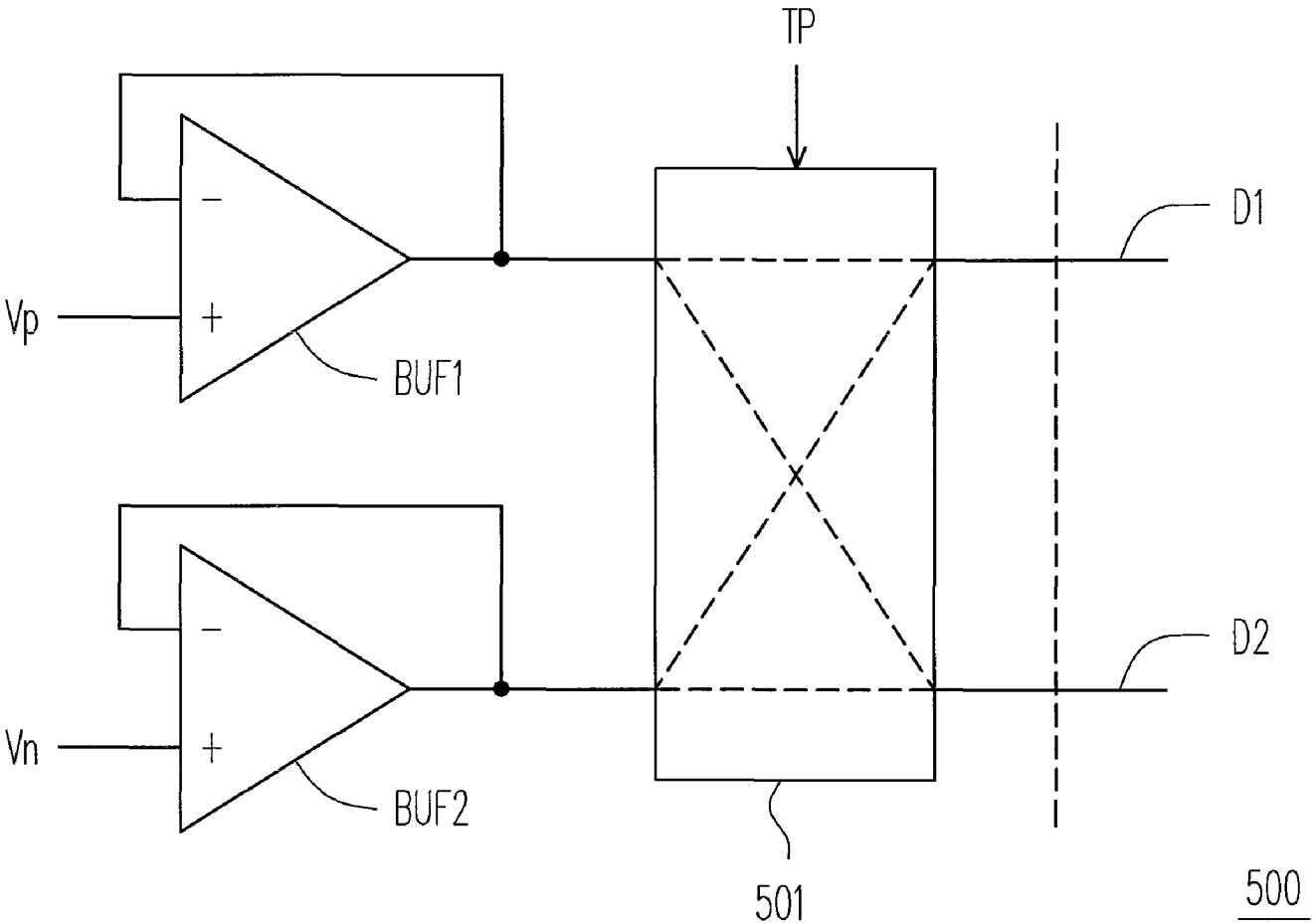
FIG. 5 is a diagram of a source driver according to an embodiment of the present invention.

As known, polarity inversion is usually performed to drive pixels on the display panel. In order to save power consumption, the source driver may include the output buffers respectively responsible for enhancing the driving signals with different polarities, such as positive polarity and negative polarity. FIG. 5 is a diagram of a source driver according to an embodiment of the present invention. Referring to FIG. 5, the source driver 500 includes an output buffer BUF1 to enhance the driving signal Vp with positive polarity, an output buffer BUF2 to enhance the driving signal Vn with negative polarity, and an output multiplexer 501 to deliver the driving signals Vp and Vn to data lines D1 and D2 on the display panel, wherein the output multiplexer 501 is conducted according to the switching signal TP. The output buffer BUF1 can be implemented by the output buffer 200 or the output buffer 400 in the said embodiments since the output buffer 200/400 includes N-type differential pair which can receive the driving signal Vp having high voltage level. The following give another embodiment to teach people ordinarily skilled in the art to practice the output buffer BUF2.

Figure 6:
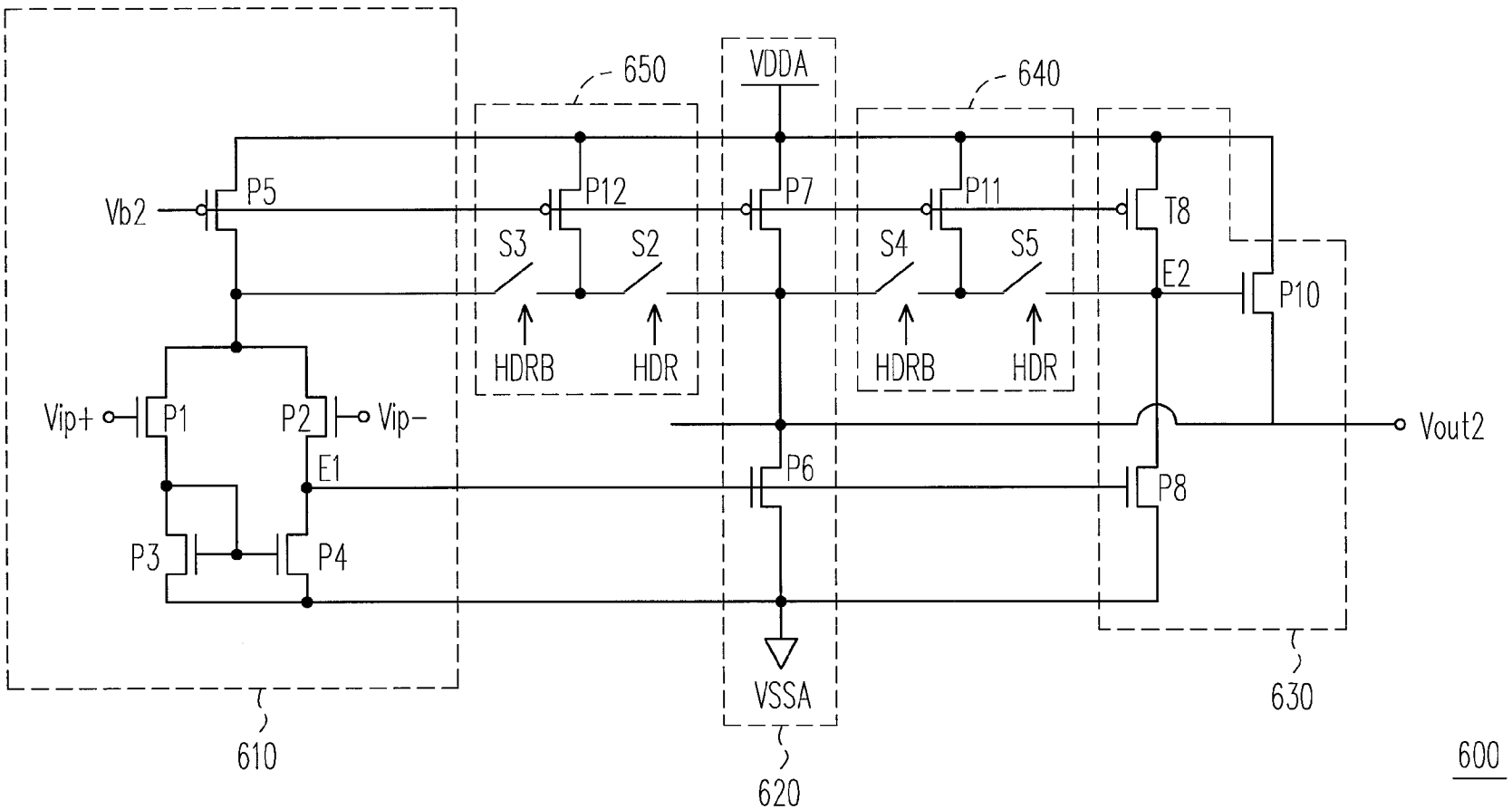
FIG. 6 is a circuit diagram of an output buffer according an embodiment of to the present invention.

FIG. 6 is a circuit diagram of an output buffer according to an embodiment of the present invention. Referring to FIG. 4 and FIG. 6, the difference between the embodiments in FIG. 4 and FIG. 6 is that an input stage module 610 of the output buffer 600 includes P-type differential pair 611, wherein the output buffer 600 is also a unity gain buffer in which an input terminal Vip− is coupled to an output terminal Vout2. The operation of the output buffer 600 is similar to the operation of the output buffer 400. When the signal at the input terminal Vip+ is larger than the signal at the input terminal Vip−, a voltage at a first connection terminal E1 of the input stage module 610 is decreased to make transistors P6 and P8 not conduct. In the meanwhile, a voltage at a second connection terminal E2 of a second output stage module 630 is increased by a conducted transistor P9, which is conducted by a bias voltage Vb2, and then a transistor T10 is conducted to pull high a voltage at the output terminal Vout2. In addition, when the signal at the input terminal Vip+ is less than the signal at the input terminal vip−, the voltage at the first connection terminal E1 is increased to conduct the transistors P6 and P8. In the meanwhile, the conducted transistor P6 forms a discharging path to decrease the voltage at the output terminal Vout2, and the conducted transistor P8 increases the voltage at the second connection terminal E2 to make the transistor P10 not conduct.

In the embodiment of the present invention, a first control module 640 selectively connects a current source implemented by a transistor P11 to the first output stage module 620 or to the second output stage module 630 according to the indication signal HDR. Besides, a second control module 630 selectively connects a current source implemented by a transistor P12 to the first stage module 620 or to the input stage module 610 according to the indication signal HDR. Hence, the driving ability of the output buffer 600 can be enhanced by the operations of the first control module 640 and/or the second control module 650.

In summary, the output buffer and the source driver using the same in the said embodiment utilizes the first control module to selectively connect the first current source to the first output stage module or to the second output stage module, such that the current flowing through the first output stage module and the current flowing through the second output stage module can be adjusted for increasing the driving abilities of charging and discharging. In addition, the second control module can selectively connect the third current source to the input stage module or to the first output stage module for adjusting a tail current of the input stage module and the current flowing through the first output stage module.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A source driver, adapted to drive a display panel, comprising:

an output buffer, comprising:

an input stage module, having a first input terminal receiving a driving signal, a second input terminal receiving an output signal, and a first connection terminal generating a first bias signal according to the driving signal and the output signal;

a first output stage module, coupled to the first connection terminal of the input stage module for generating the output signal via an output terminal of the output buffer to the display panel according to the first bias signal; and a second output stage module, coupled to the first connection terminal of the input stage module for generating a second bias signal via a second connection terminal thereof according to the first bias signal, and comprising:

a first switch, having a first terminal coupled to the output terminal of the output buffer, and a second terminal coupled to a first voltage, wherein the first switch is conducted according to the second bias signal; and a first control module, directly coupled between the output terminal of the output buffer, and the second connection terminal of the second output stage module for selectively and directly connecting a first current source to the output terminal of the output buffer or to the second connection terminal of the second output stage module according to an indication signal; and an output multiplexer, coupled between the output terminal of the output buffer and the display panel for conducting the output terminal of the output buffer to the display panel according to a switching signal.

2. The source driver as claimed in claim 1, wherein the input stage module comprises:

a differential pair, comprising:

a first transistor, having a gate receiving the driving signal, a first source/drain, and a second source/drain; and a second transistor, having a gate receiving the output signal, a first source/drain serving as the first connection terminal for generating the first bias signal, and a second source/drain coupled to the second source/drain of the first transistor; and a current mirror circuit, coupled to the first source/drain of the first transistor and the first source/drain of the second transistor for respectively providing a first bias current and a second bias current to the first source/drain of the first transistor and the first source/drain of the second transistor; and a second current source, having a first terminal coupled to the second source/drain of the first transistor, and a second terminal coupled to the first voltage.

3. The source driver as claimed in claim 2, wherein the current mirror circuit comprises:

a third transistor, having a gate, a first source/drain coupled to a second voltage, and a second source/drain coupled to both of the gate thereof and the first source/drain of the first transistor; and a fourth transistor, having a gate coupled to the gate of the third transistor, a first source/drain coupled to the second voltage, and a second source/drain coupled to the first source/drain of the second transistor.

4. The source driver as claimed in claim 2, wherein the second current source comprises a fifth transistor having a gate coupled to a bias voltage, a first source/drain coupled to the second source/drain of the first transistor, and a second source/drain coupled to the first voltage.

5. The source driver as claimed in claim 2, further comprising:

a second control module, coupled between the second source/drain of the first transistor and the output terminal of the output buffer for selectively connecting a third current source to the second source/drain of the first transistor or to the output terminal of the output buffer according to the indication signal.

6. The source driver as claimed in claim 5, wherein the second control module comprises:

a second switch, having a first terminal coupled to the second source/drain of the first transistor, and a second terminal coupled to the third current source, wherein the second switch is conducted according to the indication signal; and a third switch, having a first terminal coupled to the second terminal of the second switch, and a second terminal coupled to the output terminal of the output buffer, wherein the third switch is conducted according to an inverted indication signal.

7. The source driver as claimed in claim 1, wherein the first output stage module comprises:

a sixth transistor, having a gate coupled to the first connection terminal of the input stage module, a first source/drain coupled to a second voltage, and a second source/drain serving as the output terminal of the output buffer; and a seventh transistor, having a gate coupled to a bias voltage, a first source/drain coupled to the second source/drain of the sixth transistor, and a second source/drain coupled to the first voltage.

8. The source driver as claimed in claim 1, wherein the second output stage module further comprises:

a eighth transistor, having a gate coupled to the first connection terminal of the input stage module, a first source/drain coupled to a second voltage, and a second source/drain generating the second bias signal; and a ninth transistor, having a gate coupled to a bias voltage, a first source/drain coupled to the second source/drain of the eighth transistor, and a second source/drain coupled to the first voltage.

9. The source driver as claimed in claim 1, wherein the first control module comprises:

a fourth switch, having a first terminal directly coupled to output terminal of the output buffer, and a second terminal coupled to the first current source, wherein the fourth switch is conducted according to an inverted indication signal; and a fifth switch, having a first terminal coupled to the second terminal of the fourth switch, and a second terminal coupled to the second connection terminal of the second output stage module, wherein the fifth switch is conducted according to the indication signal.

10. The source driver as claimed in claim 1, further comprising:

a capacitor, having a first terminal coupled to the first connection terminal of the input stage module, and a second terminal coupled to the output terminal of the output buffer.

11. The source driver as claimed in claim 1, wherein the first switch comprises:

a tenth transistor, having a gate coupled to the second connection terminal of the second output stage module for receiving the second bias signal, a first source/drain coupled to the output terminal of the output buffer, and a second source/drain coupled to the first voltage.

12. The source driver as claimed in claim 1, wherein the indication signal is asserted when the switching signal is asserted, and the indication signal is de-asserted after the switching signal is de-asserted.

13. The source driver as claimed in claim 1, wherein the indication signal is asserted when the switching signal is asserted, and the indication signal is de-asserted when the switching signal is de-asserted.

14. The source driver as claimed in claim 1, wherein the indication signal is asserted when the switching signal is de-asserted, and the indication signal is de-asserted before a scan signal associated with a scan line is de-asserted.

15. An output buffer, adapted to a source driver, comprising:

an input stage module, having a first input terminal receiving a driving signal, a second input terminal receiving an output signal, and a first connection terminal generating a first bias signal according to the driving signal and the output signal;

a first output stage module, coupled to the first connection terminal of the input stage module for generating the output signal via an output terminal of the output buffer to the display panel according to the first bias signal; and a second output stage module, coupled to the first connection terminal of the input stage module for generating a second bias signal via a second connection terminal thereof according to the first bias signal, and comprising:

a first switch, having a first terminal coupled to the output terminal of the output buffer, and a second terminal coupled to a first voltage, wherein the first switch is conducted according to the second bias signal; and a first control module, directly coupled between the output terminal of the output buffer, and the second connection terminal of the second output stage module for selectively and directly connecting a first current source to the output terminal of the output buffer or to the second connection terminal of the second output stage module according to an indication signal.

16. The output buffer as claimed in claim 15, wherein the input stage module comprises:

a differential pair, comprising:

a first transistor, having a gate receiving the driving signal, a first source/drain, and a second source/drain; and a second transistor, having a gate receiving the output signal, a first source/drain serving as the first connection terminal for generating the first bias signal, and a second source/drain coupled to the second source/drain of the first transistor; and a current mirror circuit, coupled to the first source/drain of the first transistor and the first source/drain of the second transistor for respectively providing a first bias current and a second bias current to the first source/drain of the first transistor and the first source/drain of the second transistor; and a second current source, having a first terminal coupled to the second source/drain of the first transistor, and a second terminal coupled to the first voltage.

17. The output buffer as claimed in claim 16, further comprising:

a second control module, coupled between the second source/drain of the first transistor and the output terminal of the output buffer for selectively connecting a third current source to the second source/drain of the first transistor or to the output terminal of the output buffer according to the indication signal.

18. The output buffer as claimed in claim 17, wherein the second control module comprises:

a second switch, having a first terminal coupled to the second source/drain of the first transistor, and a second terminal coupled to the third current source, wherein the second switch conducted according to the indication signal; and a third switch, having a first terminal coupled to the second terminal of the second switch, and a second terminal coupled to the output terminal of the output buffer, wherein the third switch is conducted according to an inverted indication signal.

19. The output buffer as claimed in claim 15, wherein the first control module comprises:

a fourth switch, having a first terminal coupled to output terminal of the output buffer, and a second terminal coupled to the first current source, wherein the fourth switch is conducted according to an inverted indication signal; and a fifth switch, having a first terminal coupled to the second terminal of the fourth switch, and a second terminal coupled to the second connection terminal of the second output stage module, wherein the fifth switch is conducted according to the indication signal.

* * * * *